United States Patent [19]

Gettman

[11] 4,129,934

[45] Dec. 19, 1978

[54] METHOD OF INSTALLING AND REMOVING LOCKING DEVICE FOR EARTH WORKING TOOL

[75] Inventor: Herman W. Gettman, Portland, Oreg.

[73] Assignee: ESCO Corporation, Portland, Oreg.

[21] Appl. No.: 839,183

[22] Filed: Oct. 4, 1977

Related U.S. Application Data

[63] Continuation-in-part of Ser. No. 683,175, May 4, 1976, abandoned.

[51] Int. Cl.[2] ..... A01B 15/00; F16B 19/02

[52] U.S. Cl. ..... 29/427; 37/142 A; 29/525

[58] Field of Search ..... 37/142 R, 142 A; 172/719; 29/427, 525; 85/5 M, 5 CP, 5 N, 8.3

[56] References Cited

U.S. PATENT DOCUMENTS

| | | | |
|---|---|---|---|
| 3,020,655 | 2/1962 | Launder | 37/142 A |
| 3,511,126 | 5/1970 | Watts | 37/142 A |
| 3,792,735 | 2/1974 | Radigan | 37/142 R |

*Primary Examiner*—Milton S. Mehr

*Attorney, Agent, or Firm*—Tilton, Fallon, Lungmus & Chestnut

[57] ABSTRACT

A method of installing and removing a locking device for a two-part earth working tool having aligned openings in the two parts thereof, the locking device having an elongated metal, generally cylindrical body equipped with identical flat diametrically opposed recesses intermediate the ends with identical resiliently supported metal bearing pieces in the recesses protruding beyond the cylindrical periphery of the body whereby the steps of installation and removal include the application of balanced forces on the bearing pieces to avoid shearing thereof.

3 Claims, 4 Drawing Figures

METHOD OF INSTALLING AND REMOVING LOCKING DEVICE FOR EARTH WORKING TOOL

RELATED APPLICATION

This application is a continuation-in-part of applicant's co-pending application Ser. No. 683,175 filed May 4, 1976, for Locking Device For Earth Working Tool, now abandoned.

BACKGROUND AND SUMMARY OF THE INVENTION

This invention relates to a method of installing and removing a locking device for a two-part earth working tool and, more particularly to a method utilizing a unitary device which provides a secure lock during the usual operation of the tool but which is readily removable for replacement of the wearable part of the tool.

The usual dilemma facing workers in the excavating field is to provide an outer or earth engaging element which is reliably secured to the support or holder during normal operation — but which is conveniently and readily detachable for replacement. Examples of such elements are the point parts of excavating teeth, shrouds for rippers and buckets, bit for scrapers, etc.

It will be appreciated that the element or wearable portion of the tool engaging the ground wears in an accelerated rate relative to the remainder of the tool. Very often a holder may have a life at least equal to the wear lives to 5 to 10 earth engaging elements provided thereon. Should the wearable element become inadvertently detached during normal operation — and here it is to be appreciated that normal operation contemplates severe shock and impact loads from time to time — the valuable holder may be seriously damaged. The equipment utilizing these tools is quite expensive and, in many cases, is used in remote areas so major repair is a serious problem. Thus, the principal requirement of a locking device for holding the wearable part on the support portion part of the tool is that the locking device is secure and reliable during this normal operation.

At the same time, however, because the expensive nature of the equipment, it is equally necessary to have the wear part replacement achieved with a minimum of time and labor. Many different kinds of methods utilizing locking devices have been provided over the years for this purpose. Perhaps the most intensively worked area has to do with excavating teeth (U.S. Classification 37-141, 142). Since about the turn of the century, workers in the excavating art have preferred two-part teeth where the point or tip is removable after it has become dull. By providing the tooth or tool in two parts, the amount of "throwaway" metal in the worn part is minimized. This economic consideration made it necessary to develop keys or locking devices for the two parts. Some of the early workers made use of deformable keys such can be seen in U.S. Pat. No. 2,055,265. For the most part, this type of lock has been long since discarded. If the deformed key or pin is strong enough to bear up under the harsh impacts, it became difficult to remove, particularly since it would become compacted with earth, rock dust, etc. Introducing a chisel or other deforming instrument was time consuming and often ineffective.

The same defects attended the nut and bolt type of lock (exemplified by U.S. Pat. No. 2,385,395). Removal was difficult because a powerful withdrawing force was difficult to apply. The threads could literally become closed with compacted material.

Therefore, the art turned pretty uniformly to a two-part locking device, one popular form being seen in U.S. Pat. No. 2,483,032. Generally, such devices included a metal pin of substantially rigid construction in combination with a resilient or deformable plug, usually rubber. The pin or key when driven into the aligned openings of the two-part tool would deform the rubber plug and achieve a seat, drawing the two parts of the tool tightly together. Such locking devices (which are still widely used) have the advantage of low cost because of simplicity of manufacture but have the drawback of requiring two pieces for the lock with the attendant possibility of loss and incompatibility of the two parts when the same are mass produced.

The last genre of locking device is a unitary pin of "sandwich" constuction, as exemplified by U.S. Pat. No. 3,020,655. In this class of device, the resilient material is incorporated as an integral part of the pin so that only a single element is required. This avoids the drawback of having two pieces to the lock but usually is more expensive to produce. Even more importantly, as far as the art is concerned, there had been doubts as to the ability of the sandwich type lock to provide the secure attachment required. Because of its very nature in being a unitary piece, the range of design variations available was restricted — as compared with the more popular two-piece locks.

One attempt to improve the unitary type of locking device is seen in U.S. Pat. No. 3,511,126. There, a portion of the sandwich was provided eccentric to the normally cylindrical contour to improve the holding power of the lock. However, this lock structure resisted removal by the normal and desired method of applying a dislodging force along the axis of the pin lock. Therefore, the desired ease of removal, a principal characteristic of a superior method of utilizing a locking device, was not present. Also, because the intermediate portion of the locking device was eccentrically enthickened, there was a substantial chance of shearing the intermediate portion and destroying the locking device.

When such shearing occurred, expensive down time resulted because artisans in the field normally expected the locking device to last the life of the holder and when replacing wearable elements such as points, shrouds, bits, etc., carry only the minimum replacement parts into the field. Here, it should be appreciated that the wearable parts are quite heavy notwithstanding the desirability of reducing the amount of throw away metal, being made of cast alloy steel, and therefore anything that guarantees easy of the method of replacement — such as not having to be concerned about replacing destroyed locking devices — is of substantial importance and advantage. As a consequence, the lock construction of U.S. Pat. No. 3,511,126 did not find favor with the workers in the excavating art.

The instant invention constitutes an improvement in the sandwich type of locking device and achieves the foregoing goals of secure mounting and ready dismantling without the disadvantages of the prior art — realizing this through the provision of a method utilizing a locking pin which has a pair of intermediate portions enthickened relative to the cylindrical contour of the pin in diametrically opposed positions and which include bearing pieces resiliently secured to the main body of the pin whereby the steps of installation and removal include the application of balanced forces on the bearing pieces to avoid shearing thereof.

Other advantages and characteristics may be seen in the details of construction and operation set down in the ensuing specification.

DETAILED DESCRIPTION

The invention is described in conjunction with an illustrative embodiment in the accompanying drawing, in which FIG. 1 is a perspective view in exploded form of an excavating tool practicing the teachings of this invention;

Figure 1:
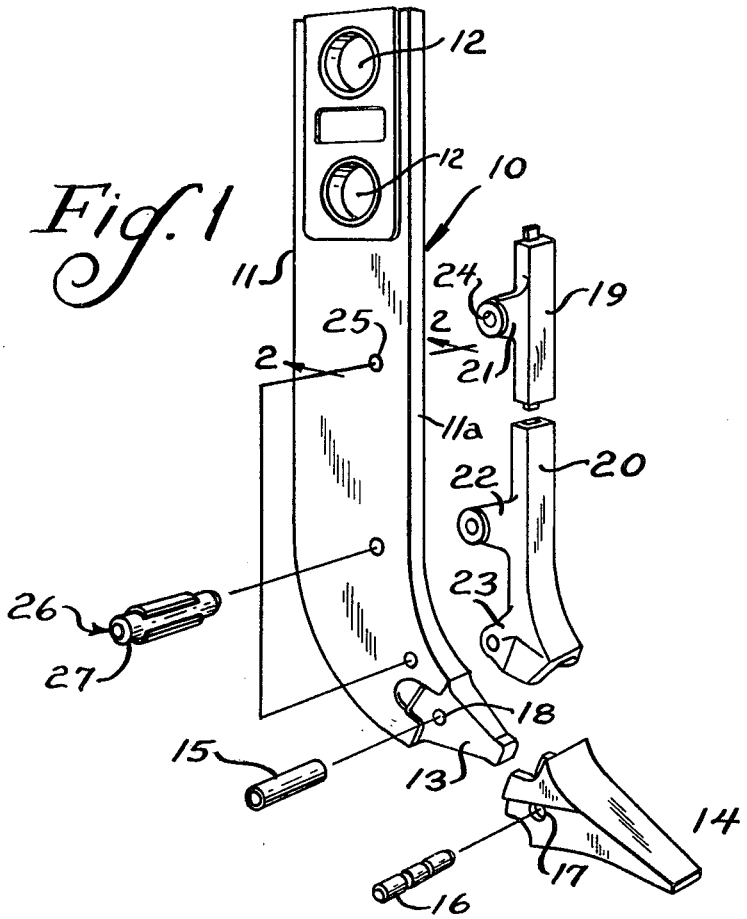

In the illustration given and with reference first to FIG. 1, the numeral 10 designates generally an excavating tool which here is illustrated in the form of a ripper. A ripper can advantageously be installed at the rear of a tractor of the like for movement parallel to and below the surface of the ground so as to develop a furrow or trench. Normally, the ripper includes an elongated shank 11 which is mounted on the propelling vehicle (not shown) by suitable pins extending through attachment pin holes 12 located at the upper end of the shank 11. It will be understood that the shank 11 is disposed in a generally vertical condition — see, for example, U.S. Pat. No. 3,026,947.

The lower end of the shank 11 is normally equipped with an integral nose portion as at 13 on which is mounted a point or tip 14. As illustrated, the point is maintained on the nose by means of a bushing 15 and pin 16 mounted in openings 17 and 18 provided in the point 14 and nose 13, respectively. However, this connection can also utilize the inventive method utilizing a locking device as described in greater detail hereinafter.

Because of the severe shocks and wear encountered by the shank, it is normally the practice to provide shrouds for the leading edge 11*a* of the shank 11. Illustrated in FIG. 1 is an upper shroud 19 and a lower shroud 20. Each shroud 19 or 20 is equipped with rearwardly extending walls at 21 relative to the shroud 19 and 22 and 23 relative to the shroud 20 which provide the means for removably mounting the shrouds 19 and 20 on the shank 11.

Figure 2:
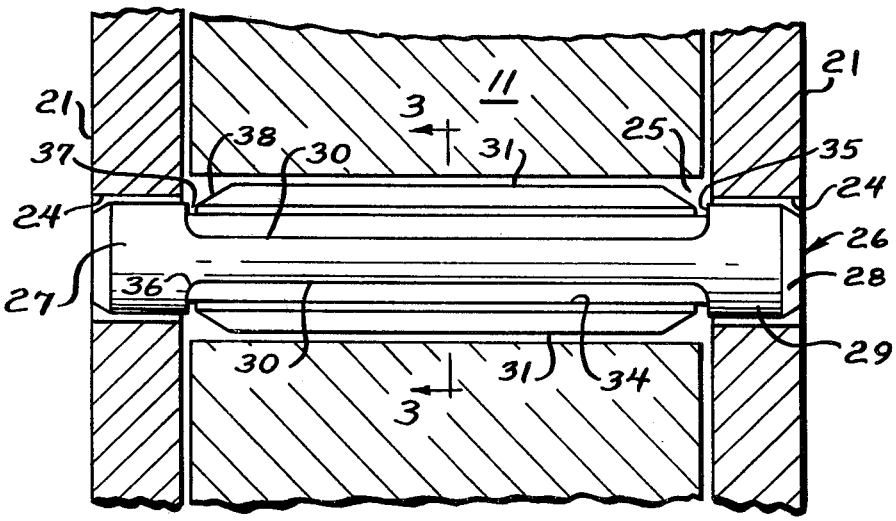
FIG. 2 is an enlarged sectional view taken along the sight line 2—2 of FIG. 1.

For the purpose of mounting the shrouds on the shank, aligned openings are provided in these two elements and which can be better appreciated from a consideration of FIG. 2. In FIG. 2, which represents a section taken along the line 2—2 of FIG. 1, the reawardly extending walls of the shroud 19 are designated by the numeral 21 and are seen to be equipped with aligned pin receiving openings as at 24. Additionally, the shank 11 is equipped with a transverse opening or bore 25 alignable with the openings 24 for the receipt of a shroud lock pin generally designated 26.

The lock pin 26 includes a generally cylindrical metal body 27 (compare FIGS. 1, 2 and 3). the body 27 has beveled ends as at 28 and end portions 29 which are positioned generally in alignment with the openings 24 of the walls 21. The generally cylindrical body 27 is notched or recessed as at 30 in diametrically opposed positions to provide a mounting for bearing peices 31 which are bonded to the body 27 by means of a resilient material such as rubber at 32 (designated only in FIG. 3).

Figure 3:
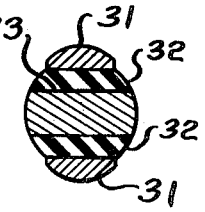
FIG. 3 is a sectional view taken along the sight line 3—3 applied to FIG. 2.
Figure 4:
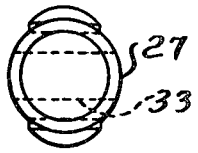
FIG. 4 is an end elevational view of the locking pin constructed according to this invention.

More particularly, the recesses 30 provided in the intermediate portion of the body 27, i.e., the portion generally located within the bore or opening 25 of the shank 11, are developed by chordal cuts as at 33 (see FIGS. 3 and 4). The bearing peices 31 are each equipped with planar bottom walls 34 confronting the flat chordal cuts 33. Further, the notches 30 each are defined by end walls 35 (see FIG. 2) which are connected to the base or chordal walls of the recesses by means of a curved connecting wall 36. The end walls 35 are speced apart a distance somewhat greater than the length of the associated bearing piece 31 so as to develop gaps 37 at each end of the order of 2–5 mm. A typical lock pin 26 may have an overall length of the order of 121 mm. with the length of each recess 30 being of the order of 89 mm. and the length of each bearing piece being about 86 mm. A somewhat larger pin lock has an overall length of the order of 126 mm. with the length of each recess 30 being of the order of 100 mm. and the length of each bearing piece being about 97 mm.

Normally, it is preferred to have a length of bearing piece 31 at least 50% of the length of the body 27. Further, it is advantageous to have the length of the bearing piece slightly less than the length of the shank opening 25 but in any event less than the distance between the walls 21 of the shroud 19. As can be appreciated from a consideration of FIG. 2, the length of the body 27 is approximately the distance between the outer end of the shroud openings 24.

I also find it advantageous to provide beveled ends as at 38 on each of the bearing pieces 31 which tends to facilitate removal in the historically-practiced manner. Artisans in the earth working art normally employ a drift pin or like instrument for transmitting force from a hammer or mallet to the flush end of the locking pin 26 and attempt to position the drift pin so that the force is exerted along the longitudinal center line of the locking pin 26. With the asymmetrically enthickened devices of the prior art the strong possibility existed of shearing the locking pin in the vicinity of the bonding resilient material 32. This required either extreme care in a situation not characterized by delicacy of operation or the ready availability of replacement locking pins. In studied constrast to this difficulty, the instant invention provides a method utilizing a pin that not only develops a secure lock under the normal arduous operation but one which is conveniently and readily removable — and quite importantly, in the normal fashion practiced by artisans over many years.

As illustrated, the pin 26, when installed is under no compression. It has a larger effective thickness or major diameter in the central body of the pin provided by the bonding of the bearing pieces 31 by the resilient material 32 to the body 27. The end portions 29 provide, in effect, ears so that the pin 26 cannot work out of its mounting in an inadvertent fashion. Although clearances are shown in the drawing, particularly FIG. 2, it will be appreciated that in some instances, mere sliding fits are all that may be required — as between the major diameter developed by the bearing pieces 31 and the uniform diameter of the wall openings 24. In some instances, it may be advantageous to maintain the intermediate portion, i.e., the portion between the end portions 29, under a slight compression as by having the major diameter developed by the bearing pieces 31 being approximately the same or slightly greater than the uniform diameter provided in the opening or bore 25.

Cooperating advantageously in providing the desirable installation and removability characteristic of the inventive locking pin is the exterior contour of each bearing piece 31. As can be appreciated best from a consideration of FIGS. 3 and 4, the bearing piece 31 has a segmental cylindrical exterior wall which, in the illustration given, is on a somwhat smaller radius of curvature than that employed to generate the generally cylindrical body 27. For example, the insert radius of curvature may be of the order of 8–10 mm. while the radius of the generally cylindrical body 27 is of the order of 9.5–12.5 mm. The chordal thickness of the body 27 between the chordal cuts 33 is of the order of 50% of the diameter of the end portions 29. Because of the balanced nature of the forces applied to the pin lock 26 during insertion and removal, the amount of metal employed in this narrower waist can be lessened so as to provide a suitable amount of resilient material 32 (of the order of 3 mm. in thickness) between each of the bearing pieces 31 and the body 27.

Further, the bevels at 38 on the bearing pieces 31 are advantageously of the order of 60° to a vertical plane while the bevels at 28 for the body 27 are of the order of 30°. Each of the bearing pieces 31 and the body 27 are advantageously constructed of alloy steel and it is preferred to provide the alloy steel for the bearing piece 31 of a somewhat harder nature than that provided for the pin body 27. For example, the Brinell hardness number for the bearing pieces 31 can be in the range of 475–500 while that for the body 27 may be in the range 325–350. The resilient material, i.e., rubber 32 is advantageously natural molded rubber having a Shore durometer of about 60.

In the operation of the invention, the locking pin 26 is provided with symmetrical, resilient enthickened portions defined by the bearing pieces 31 and resilient material 32. The bore 25 of the tool holder or shank 11 is constructed to receive the locking pin 26. The wearable elements or shrouds 19, 20 having spaced apart walls 21 with the aligned openings 24 in the walls 21 being similarly constructed to receive the locking pin 26. The shroud 19 is then installed on the shank 11 so that the bore 25 in the shank 11 and the openings 23 in the shroud 19 are in alignment. The locking pin 26 is then driven into the aligned bore 25 and openings 24 with the driving force being transmitted along the longitudinal center line of the pin 26. The openings 24 in the shroud 18 are of a diameter slightly less than the width of the locking pin 26 measured across the resiliently enthickened portions (or major dimension) defined by the bearing pieces 31 and resilient material 32 so as to cause equal compressive forces in the resiliently enthickened portions as the locking pin 26 is driven through the openings 24 in the shroud 19. The locking pin 26 is driven out of the aligned bore 24 and openings 24 at a later point in time with the driving force again being transmitted along the longitudinal center line of the pin 26. The shroud or other wearable element 19 can then be removed from the holder or shank 11. With these features, the inventive method makes it possible to reuse the locking pin to install another wearable element on the holder since shearing of the locking pin is substantially precluded.

While in the foregoing specification a detailed description of an embodiment of the invention has been set down for the purpose of illustration, many variations in the details hereingiven may be made by those skilled in the art without departing from the spirit and scope of the invention.

I claim:

1. A method of installing and removing the wearable part of a two part excavating tool comprising the steps of providing a locking pin having resiliently enthickened portions disposed symmetrically relative to the longitudinal center line of said pin, said pin including a unitary relatively elongated body of generally cylindrical transverse section having diametrically opposed, longitudinally extending peripheral portions removed to provide a pair of recesses inwardly of the body ends to receive and support said resiliently enthickened portions, said resiliently enthickened portions including an elongated bearing piece in each of said recesses having a generally clyindrical outer wall portion and a pad for resilient material bonding each of said bearing pieces in its associated notch, said resilient material when not under compression being sized and arranged to position said outer wall portion radially outward of said generally cylindrical body, providing a holder part having a bore constructed to receive said locking pin, said wearable part having spaced apart walls, said walls having aligned openings also being constructed to receive said locking pin, installing said wearable part on said holder part so that said bore in said holder part and said openings in said wearable part are in alignment, driving said locking pin into said aligned bore and openings with the driving force being transmitted along the longitudinal center line of said pin, said openings in said wearable part being of a diameter slightly less than the width of said locking pin measured across said resiliently enthickened portions so as to cause equal compressive forces in said resiliently enthickened portions as said locking pin is driven through said openings in said wearable part, driving said locking pin out of said aligned bore and openings at a later point in time with the driving force being transmitted along the longitudinal center line of said pin, whereby shearing of said locking pin is substantially precluded because of equal compressive forces being exerted on said resiliently enthickened portions, and removing said excavating tool from said tool holder.

2. The method of claim 1 in which said recesses each have a base wall chordally related to said generally cylindrical body, said base walls being parallel and spaced apart a distance approximately 50% of the diameter of said body and being spaced equally from the axis of said body, each of said bearing pieces having a generally planar wall confronting its associated base wall.

3. The method of claim 2 in which and bore in said holder part is sized to receive said resiliently enthickened portions therein without compressing said pads of resilient material.

* * * * *